US006832561B2

(12) United States Patent
Johnson

(10) Patent No.: US 6,832,561 B2
(45) Date of Patent: Dec. 21, 2004

(54) STUDENT WORK STATION

(76) Inventor: Sharon T. Johnson, 6301 N. Sheridan Rd., #4P, Chicago, IL (US) 60660

( * ) Notice: Subject to any disclaimer, the term of this patent is extended or adjusted under 35 U.S.C. 154(b) by 40 days.

(21) Appl. No.: 09/881,462

(22) Filed: Jun. 14, 2001

(65) Prior Publication Data

US 2002/0189504 A1 Dec. 19, 2002

(51) Int. Cl.[7] ..... A47B 37/00
(52) U.S. Cl. ..... 108/50.01
(58) Field of Search ..... 108/50.01, 50.11, 108/50.16, 91, 92, 93, 94, 95; 312/239, 114, 194, 223.3, 107, 108, 102; 297/136, 137

(56) References Cited

U.S. PATENT DOCUMENTS

| | | | | |
|---|---|---|---|---|
| 11,140 | A | * | 6/1854 | Robinson |
| 189,749 | A | * | 4/1877 | King |
| 1,293,952 | A | | 2/1919 | Shirley |
| D93,059 | S | * | 8/1934 | Walker |
| 2,277,929 | A | * | 3/1942 | Meyer |
| D141,359 | S | | 5/1945 | Carlson |
| D143,494 | S | * | 1/1946 | Lamm |
| 2,660,504 | A | * | 11/1953 | Bridge |
| 3,366,415 | A | * | 1/1968 | Cooper |
| 3,869,992 | A | | 3/1975 | Kramer |
| 4,237,796 | A | * | 12/1980 | Gordon et al. |
| 4,345,803 | A | * | 8/1982 | Heck |
| 4,679,509 | A | | 7/1987 | Sampson, Jr. |
| 4,894,600 | A | | 1/1990 | Kearney |
| 5,410,972 | A | * | 5/1995 | Schairbaum ..... 108/50.01 |
| D377,873 | S | | 2/1997 | Flototto |
| D405,981 | S | | 2/1999 | Alexander et al. |
| 5,865,125 | A | | 2/1999 | Alexander et al. |
| 5,865,616 | A | * | 2/1999 | Woy |
| D408,171 | S | | 4/1999 | Belka et al. |
| D409,419 | S | | 5/1999 | Wilkinson |
| D422,429 | S | | 4/2000 | Belka et al. |
| D423,828 | S | | 5/2000 | Wilkinson |
| 6,360,494 | B1 | * | 3/2002 | Emerson ..... 52/106 |

FOREIGN PATENT DOCUMENTS

| | | | |
|---|---|---|---|
| JP | 8-33693 | * | 2/1996 |

* cited by examiner

*Primary Examiner*—Jose V. Chen
(74) *Attorney, Agent, or Firm*—Michael R. McKenna

(57) ABSTRACT

A student work station, comprising an elevated desk with a horizontal work surface, a storage surface disposed at a spaced distance beneath the work surface, and a transparent peripheral wall, that maximizes reachable work and storage surfaces available to the student. The work station is designed for easy access and particularly advantageous for disabled students confined to a wheelchair. The transparent peripheral wall allows anything stored on the storage surface to be visible to a teacher or other students.

20 Claims, 1 Drawing Sheet

STUDENT WORK STATION

BACKGROUND OF THE INVENTION

This invention relates to a student work station that maximizes reachable work and storage surfaces available to the student. The work station is designed for easy access and particularly advantageous for disabled students confined to a wheelchair.

Alternative technology is available in the form of an adaptive work station in accordance with U.S. Pat. No. 4,894,600, which has a work table top in truncated U-shape with electronically controlled height adjustable legs which allow a disabled person to utilize the station while sitting in a wheelchair. Another table in accordance with U.S. Pat. No. 4,679,509 is designed for ease of use by the occupant of a wheelchair which has a shaped, cut-back, front edge enabling the user to have greater access to the working surface. U.S. Pat. Nos. 1,293,952 and 5,865,125 teach other truncated U-shaped desks. For most students and particularly disabled students, these prior art inventions fail to achieve their primary objective of greater access to the working surface.

To alleviate this problem, and others which will become apparent from the disclosure which follows, the student work station of the present invention conveniently provides an elevated desk with a horizontal work surface, a storage surface disposed at a spaced distance beneath the work surface, and a transparent peripheral wall that is disposed between the work surface and the storage surface. The student work station of this important invention has a circular shape and an entryway for a wheeled chair, such as a wheelchair or a chair on rollers. The student can rotate on a chair to face a plurality of equally accessible work and storage surface portions. For wheelchair applications, the storage shelf is cut back so that student can rotate in the wheelchair. The structural arrangement of the desk surfaces provides uniformly reachable work and storage surfaces to the student regardless of disability.

Additionally, since a transparent peripheral wall that is used as a safety feature, anything stored on the storage surface will be visible to a teacher or others students.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THE INVENTION

It is an object of the student work station of the present invention to provide a student desk that maximizes the reachable work surface available to the student.

It is an object of the student work station of the present invention to provide a student desk that maximizes the reachable storage surface available to the student.

It is another object of the student work station of the present invention to a work station that is designed for easy student access, particularly for a disabled student confined to a wheelchair.

Another object of the student work station of the present invention is to present a safe desk—one where anything stored on the storage surface will be visible to a teacher or others students.

It is yet another object of the student work station of the present invention to provide a work station that is a moveable assemblage.

Still other advantages will be apparent from the disclosure that follows.

SUMMARY OF THE INVENTION

The invention relates to a student work station comprising an elevated desk, having means for supporting the elevated desk, with a horizontal work surface, a storage surface disposed at a spaced distance beneath the work surface, and a peripheral wall. The peripheral wall is disposed between the work surface and the storage surface. The peripheral wall is transparent so that anything stored on the storage surface is visible to a teacher or others.

Additionally, to provide greater security to teachers and other students, the work surface can be transparent as well.

Preferably, the work surface is in a shape of a first circular ring sector and the storage surface is in a shape of a second circular ring sector and each of the first circular ring sector and the second circular ring sector have a first terminal edge and a second terminal edge, said edges defining an entryway.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Preferred embodiments of the invention are described hereinafter with reference to the accompanying drawing wherein.

DETAILED DESCRIPTION OF THE INVENTION

Figure 1:
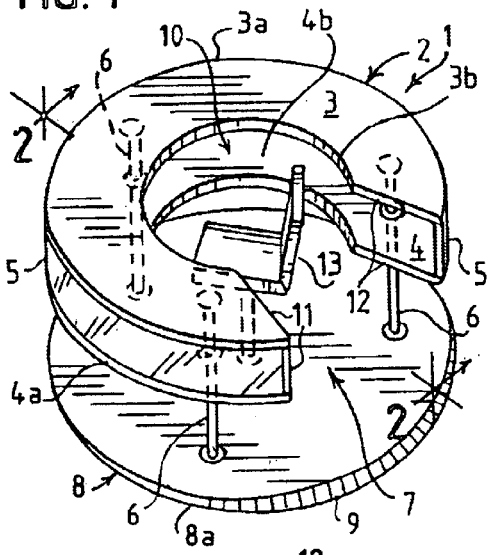
FIG. 1 is a perspective view of a first preferred embodiment of the student work station of the present invention showing particularly the transparent peripheral wall and a base, which supports the means for supporting the elevated desk and a rotatable centrally located chair, having an outer periphery, a predetermined thickness, and an incline disposed in line with an entryway.

The preferred embodiments depicted in the drawing comprise a student work station that maximizes reachable work and storage surfaces available to the student. The work station is designed for easy access and particularly advantageous for disabled students confined to a wheelchair. It has a transparent peripheral wall that is used as a safety feature, since anything stored on the storage surface will be visible to a teacher or other students. A transparent work surface may also be employed. A base can be provided to support means for supporting the elevated desk and a rotatable centrally located chair. The base rests on the floor.

Means for supporting an elevated desk may include any number of known arrangements including a conical support with an opening to coincide with an entryway, any number of support legs with at least three support legs being preferred.

Additionally, a storage surface having an interior peripheral edge with a radius of curvature which is larger by a predetermined amount than a radius of curvature of an inner peripheral edge of the work surface may be employed to allow additional room for the arms of a wheelchair as it is rotated therein.

Without departing from the generality of the invention disclosed herein and without limiting the scope of the invention, the discussion that follows, will refer to the invention as depicted in the drawing.

The preferred embodiments of the apparatus depicted in the drawing comprise a student work station 1 comprising an elevated desk 2 with a horizontal work surface 3, a storage surface 4 disposed at a spaced distance beneath the work surface, and a peripheral wall 5.

The peripheral wall 5 is disposed between the work surface 3 and the storage surface 4. The peripheral wall is transparent so that anything stored on the storage surface is visible to a teacher or others. The elevated desk has means for supporting the elevated desk which preferably has at least three support legs 6.

Preferably, the peripheral wall extends from the work surface to the storage surface.

In another preferred aspect of the student work station, the work surface 3 has an outer peripheral edge 3*a*, the storage surface 4 has an exterior peripheral edge 4*a*, and the peripheral wall 5 extends from the outer peripheral edge 3*a* of the work surface 3 to the exterior peripheral edge 4*a* of the storage surface 4. Moreover, the outer peripheral edge of the work surface can lie directly above the exterior peripheral edge of the storage surface and the peripheral wall can be vertically disposed, as shown in FIGS. 1–4.

Additionally, to provide greater security to teachers and other students, the work surface 3 can be transparent as well.

In a preferred embodiment of the student work station, as shown in the drawing, the work surface 3 is in a shape of a first circular ring sector and the storage surface 4 is in a shape of a second circular ring sector and each of the first circular ring sector and the second circular ring sector have a first terminal edge 11 and a second terminal edge 12, the first terminal edge and the second terminal edge of each of the work surface and the storage surface defining an entryway 7.

As shown in the drawing, the entryway 7 may be uniform in width, as for example, the first terminal edge 11 of each of the first circular ring sector and the second circular ring sector can be parallel and the second terminal edge 12 of each of the first circular ring sector and the second circular ring sector are parallel.

Figure 5:
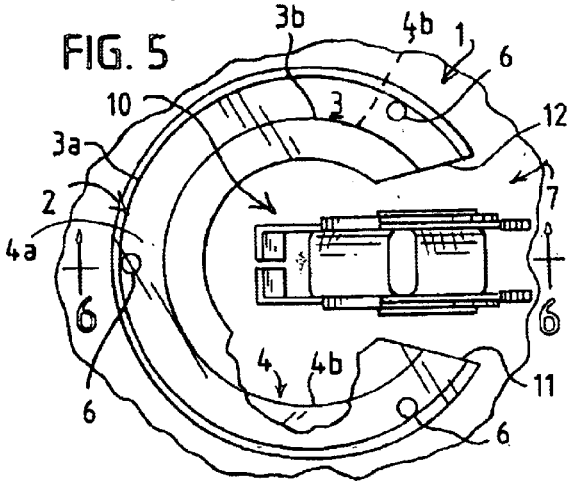
FIG. 5 is a perspective view of a third preferred embodiment of the student work station of the present invention showing particularly a storage surface having an interior peripheral edge with a radius of curvature which is larger by a predetermined amount than a radius of curvature of an inner peripheral edge of the work surface to allow additional room for the arms of a wheelchair as it is rotated therein.

Referring to FIG. 5, the entryway 7 may be outwardly expanding, as for example, the first terminal edge 11 of each of the first circular ring sector and the second circular ring sector lie in a first vertical plane and the second terminal edge 12 of each of the first circular ring sector and the second circular ring sector lie in a second distinct vertical plane. The first terminal edge and the second terminal edge can be parallel or diverge outwardly.

Figure 2:
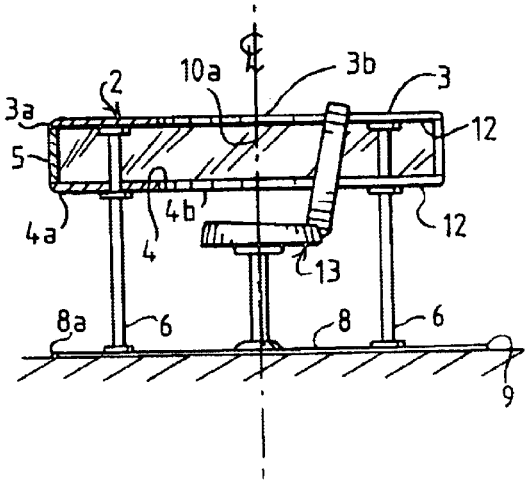
FIG. 2 is a cross-sectional view taken along the line 2—2 of FIG. 1, showing particularly the base resting on the floor and the incline of the base of the first preferred embodiment of the student work station of the present invention.

As shown in FIGS. 1 and 2, the preferred aspects of the student work station can include a base 8 which supports the means for supporting the elevated desk. The base may have an outer periphery 8*a* and a predetermined thickness.

The outer periphery 8*a* may further have a circular shape and an incline 9 disposed in line with the entryway 7.

In another preferred embodiment, the student work station 1 comprises an elevated desk 2 with a work surface 3, a storage surface 4 disposed at a spaced distance beneath the work surface, and a peripheral wall 5. The work surface has an outer peripheral edge 3*a* and a shape of a first circular ring sector. The storage surface has an exterior peripheral edge 4*a* and a shape of a second circular ring sector. Each of the first circular ring sector and the second circular ring sector has a first terminal edge 11 and a second terminal edge 12. The first terminal edge and the second terminal edge of each of the work surface and the storage surface define an entryway 7, and the peripheral wall 5 extends from the outer peripheral edge 3*a* of the work surface to the exterior peripheral edge 4*a* of the storage surface and is transparent, so that anything stored on the storage surface is visible through the peripheral wall 5. Additionally, the elevated desk has at least three support legs 6.

Figure 4:
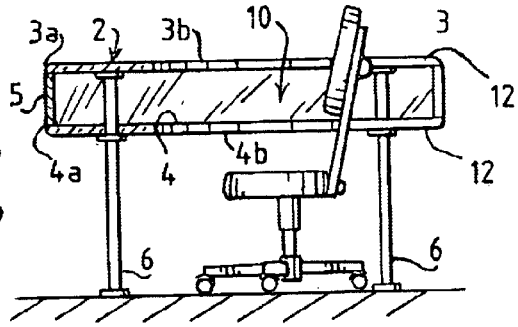
FIG. 4 is a cross-sectional view of the second preferred embodiment of the student work station taken along the line 4—4 of FIG. 3.
Figure 6:
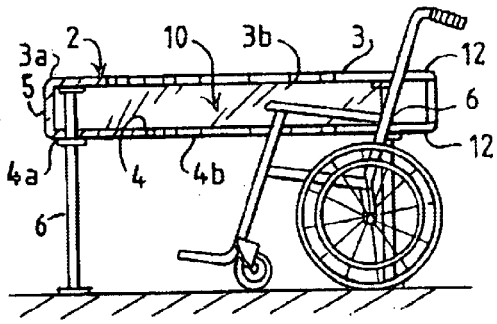
FIG. 6 is a cross-sectional view of the third preferred embodiment of the student work station taken along the line 6—6 of FIG. 5.

This student work station may further include a base 8, which supports the at least three support legs, has an outer periphery 8*a* and a predetermined thickness. Furthermore, the outer periphery 8*a* may have a circular shape and an incline 9 disposed in line with the entryway 7. In this way, a wheeled chair (as shown in FIGS. 4 and 6) can be rolled over the incline 9 of FIGS. 1 and 2, onto the base 8, through the entryway 7 and disposed within a central opening 10 of the first and second ring sectors.

Figure 3:
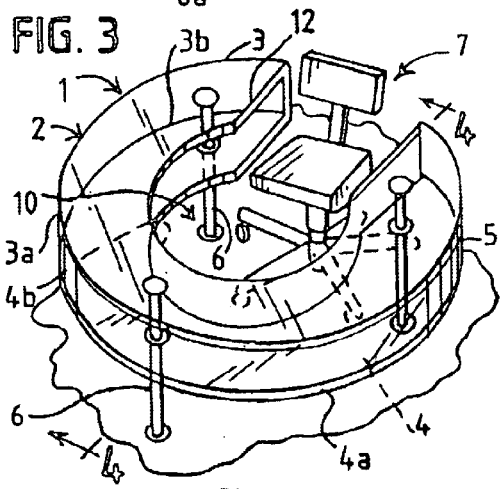
FIG. 3 is a perspective view of a second preferred embodiment of the student work station of the present invention showing particularly a transparent work surface and peripheral wall, and an entryway suitably sized to accommodate a wheeled chair which can be rotated while positioned centrally in the desk.

Moreover, the student work station may further comprise a chair 13 with a swivel seat disposed within a concentric opening 10*a* of the first and second ring sectors. The work surface 3 may also be transparent, as shown in FIG. 3.

Another preferred embodiment of the student work station comprises an elevated desk with at least three support legs, a work surface, a storage surface disposed at a spaced distance beneath the work surface, and a peripheral wall. The work surface 3 has an outer peripheral edge 3*a*, an inner peripheral edge 3*b*, and a shape of a first circular ring sector. The storage surface 4 has an exterior peripheral edge 4*a*, an interior peripheral edge 4*b*, and a shape of a second circular ring sector. The first circular ring sector and the second circular ring sector are concentric.

The interior peripheral edge 4*b* has a radius of curvature which is larger by a predetermined amount than a radius of curvature of the inner peripheral edge 3*b* of the work surface, as shown in FIG. 5, to allow additional room for the use of a wheelchair. Each of the first circular ring sector and the second circular ring sector has a first terminal edge 11 and a second terminal edge 12. The first terminal edge and the second terminal edge of each of the work surface and the storage surface defining an entryway; and the peripheral wall extending from the outer peripheral edge 3*a* of the work surface to the exterior peripheral edge 4*a* of the storage surface and is transparent so that anything stored on the storage surface is visible through the peripheral wall 5. Thus, a wheelchair with arms at a height of the storage surface can be rolled through the entryway and can be disposed within a central opening 10 of the first and second ring sectors of the elevated desk and freely rotatable therein independent of obstruction of the arms of the wheelchair or the legs of the student by the storage surface.

Moreover, to better accommodate the wheelchair and the student therein, each of the at least three support legs 6 of the student work station 1 can be disposed proximate to both the outer peripheral edge 3*a* and the exterior peripheral edge 4*a* of the desk, as shown in FIG. 5.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is base, may readily be utilized as a basis for the designing of other structures, methods and systems for carrying out the several purposes of the present invention. It is important, therefore, that the claims be regarded as including such equivalent constructions insofar as they do not depart from the spirit and scop of the present invention.

My invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A student work station comprising a work surface for student work, a storage surface disposed at a spaced distance beneath the work surface, and a safety means for visually accessing student articles disposed on the storage surface, said safety means comprising a transparent peripheral wall disposed between the work surface and the storage surface; and means for supporting the work surface, the storage surface, and the safety means above a floor, wherein said means for supporting supports the work surface at a height above the floor accessible for work to a student seated on a chair at the student work station, and wherein said means for supporting supports the storage surface at a sufficient distance from the floor to allow the student seated on the chair at the student work station to freely position at least a distal portion of his or her legs under the storage surface, whereby, a student seated on a chair at the student work station can do work on the work surface, store a variety of student articles on the storage surface, and freely position the at least a distal portion of his or her legs under the storage surface, while the variety of student articles on the storage surface can be safely noted by a teacher from outside the student work station.

2. The student work station of claim 1, wherein the peripheral wall extends from the work surface to the storage surface.

3. The student work station of claim 1, wherein the work surface has an outer peripheral edge, the storage surface has an exterior peripheral edge, and the peripheral wall extends from the outer peripheral edge of the work surface to the exterior peripheral edge of the storage surface.

4. The student work station of claim 3, wherein the outer peripheral edge of the work surface lies directly above the exterior peripheral edge of the storage surface and the peripheral wall is vertically disposed.

5. The student work station of claim 1, wherein the work surface is transparent.

6. The student work station of claim 1, wherein the work surface is in a shape of a first circular ring sector and the storage surface is in a shape of a second circular ring sector, each of said first circular ring sector and said second circular ring sector have a first terminal edge and a second terminal edge, said first terminal edge and said second terminal edge of each of the work surface and the storage surface defining an entryway.

7. The student work station of claim 6, wherein the first terminal edge of each of the first circular ring sector and the second circular ring sector are parallel and wherein the second terminal edge of each of the first circular ring sector and the second circular ring sector are parallel.

8. The student work station of claim 6, wherein the first terminal edge of each of the first circular ring sector and the second circular ring sector lie in a first vertical plane and the second terminal edge of each of the first circular ring sector and the second circular ring sector lie in a second vertical plane.

9. The student work station of claim 6, wherein the first terminal edge and the second terminal edge are parallel.

10. The student work station of claim 6, wherein the first terminal edge and the second terminal edge diverge outwardly.

11. The student work station of claim 6, further comprising a base, which supports the means for supporting, has an outer periphery and a predetermined thickness.

12. The student work station of claim 11, wherein the outer periphery has a circular shape and an incline disposed in line with the entryway.

13. The student work station of claim 1, further comprising a base which supports the means for supporting.

14. A student work station comprising a work surface for student work, a storage surface disposed at a spaced distance beneath the work surface, at least three support legs, and a safety means for visually accessing student articles disposed on the storage surface comprising a peripheral wall, said work surface having an outer peripheral edge and a shape of a first circular ring sector, said storage surface having an exterior peripheral edge and a shape of a second circular ring sector, each of said first circular ring sector and said second circular ring sector having a first terminal edge and a second terminal edge, said first terminal edge and said second terminal edge of each of the work surface and the storage surface defining an entryway, and said peripheral wall extending from the outer peripheral edge of the work surface to the exterior peripheral edge of the storage surface and being transparent so that anything stored on the storage surface is visible through the peripheral wall, said at least three support legs support the work surface at a height above the floor that is accessible for work to a student seated on a chair at the student work station, and said at least three support legs support the storage surface at a sufficient distance from the floor to allow the student seated on the chair at the student work station to freely position at least a distal portion of his or her legs under the storage surface, whereby, a student seated on a chair at the student work station can do work on the work surface, store a variety of student articles on the storage surface, and freely position at least a distal portion of his or her legs under the storage surface, while the variety of student articles on the storage surface can be safely noted by a teacher from outside the student work station.

15. The student work station of claim 14, further comprising a base, which supports the at least three support legs, has an outer periphery and a predetermined thickness.

16. The student work station of claim 15, wherein the outer periphery has a circular shape and an incline disposed in line with the entryway, whereby, a wheeled chair can be rolled over the incline, onto the base, through the entryway and disposed within a central opening of the first and second ring sectors.

17. The student work station of claim 15, further comprising a chair with a swivel seat disposed within a concentric opening of the first and second ring sectors.

18. The student work station of claim 14, wherein the work surface is transparent.

19. A student work station comprising a work surface for student work, a storage surface disposed at a spaced distance beneath the work surface, at least three support legs, and a safety means for visually accessing student articles disposed on the storage surface comprising a peripheral wall, said work surface having an outer peripheral edge, an inner peripheral edge, and a shape of a first circular ring sector;

said storage surface having an exterior peripheral edge, an interior peripheral edge, and a shape of a second circular ring sector;

said first circular ring sector and said second circular ring sector being concentric;

said interior peripheral edge having a radius of curvature which is larger by a predetermined amount than a radius of curvature of the inner peripheral edge of the work surface and said radius of curvature of the interior peripheral edge defining a work surface interior dimension being twice said radius of curvature, said work surface interior dimension being larger than a maximum horizontal transverse dimension of a wheelchair with arms on which a student at the work station can be seated;

each of said first circular ring sector and said second circular ring sector having a first terminal edge and a second terminal edge, said first terminal edge and said second terminal edge of each of the work surface and the storage surface defining an entryway, said entryway having a distance between said first terminal edge and said second terminal edge of each of the work surface and the storage surface sufficiently large to accommodate the ingress and egress of the wheelchair;

said peripheral wall extending from the outer peripheral edge of the work surface to the exterior peripheral edge of the storage surface and being transparent so that anything stored on the storage surface is visible through the peripheral wall; and said at least three support legs supporting the work surface, the storage surface, and the safety means above a floor, said work surface being supported at a height above the floor that is accessible for work to a student seated on the wheelchair at the student work station, and wherein said means for supporting supports the storage surface at a sufficient distance from the floor to allow the student seated on the chair at the student work station to freely position at least a distal portion of his or her legs under the storage surface, whereby, the wheelchair with arms having a height of the storage surface can be rolled through the entryway and can be disposed within a central opening of the first and second ring sectors and freely rotatable therein independent of obstruction of the arms by the storage surface, and a student seated on the wheelchair at the student work station can do work on the work surface, store a variety of student articles on the storage surface, and freely position at least a distal portion of his or her legs under the storage surface, while the variety of student articles on the storage surface can be safely noted by a teacher from outside the student work station.

20. The student work station of claim 19, wherein each of the at least three support legs are disposed proximate to both the outer peripheral edge and the exterior peripheral edge.

* * * * *